US006199213B1

(12) United States Patent
Whang

(10) Patent No.: US 6,199,213 B1
(45) Date of Patent: Mar. 13, 2001

(54) FREE-SIZE FITTED ITEM FOR THE HEAD

(75) Inventor: Joseph Whang, Rancho Palos Verdes, CA (US)

(73) Assignee: Magic Headwear, Inc., Carson, CA (US)

( * ) Notice: Subject to any disclaimer, the term of this patent is extended or adjusted under 35 U.S.C. 154(b) by 0 days.

(21) Appl. No.: 09/586,437

(22) Filed: Jun. 2, 2000

(51) Int. Cl.[7] ..... A42B 1/00
(52) U.S. Cl. ..... 2/181
(58) Field of Search ..... 2/171, 181, 209.12, 2/175.1, 195.1, DIG. 11

(56) References Cited

U.S. PATENT DOCUMENTS 1,697,919 * 1/1929 Knepper ..... 2/DIG. 11
2,214,996 * 9/1940 Dorsey ..... 2/171
2,544,798 * 3/1951 Lippman ..... 2/DIG. 11
5,566,395 * 10/1996 Nebeker ..... 2/181
5,956,773 * 9/1999 LaMantia ..... 2/195.1
5,983,398 * 11/1999 Kronenberger ..... 2/181
6,122,774 * 9/2000 Park ..... 2/181

* cited by examiner

*Primary Examiner*—Bibhu Mohanty
(74) *Attorney, Agent, or Firm*—Pillsbury Winthrop LLP

(57) ABSTRACT

A modified cap construction utilizes the natural stretch of fabrics to acquire a multi-axial flexibility capable of comfortably fitting wearers having a range of head sizes. The same theory may be applied to any article of manufacture that is designed to be worn on or around the head. The unique sweatband portion is fashioned with a soft, absorbent and non-oppressive multi-axially stretchable fabric that is attached along its lower edge to the interior surface of the material of the hat. The structure and multiple size capability of the free size fitted cap offers the aesthetic appeal of the fixed size style cap together with the feel of its custom fit and the lasting shape of its fabric.

13 Claims, 2 Drawing Sheets

FREE-SIZE FITTED ITEM FOR THE HEAD

BACKGROUND OF THE INVENTION

The present invention relates to an improved construction of headwear so that it resembles a single or fixed-size item, but is capable of fitting wearers within a pre-determined range of head sizes.

In the past, a variety of means have been used to construct a hat that fits the user's head properly. Some sport hats are constructed with an adjustable strap and closure mechanism, usually located opposite the visor of the hat. Examples of closure mechanisms for such straps include plastic snaps, VELCRO and metal buckles. The snap mechanism is generally designed with two straps, one coming from each side of the 'hole' in the circumference of the band of the hat. One such strap has a plurality of holes, while the other such strap has a plurality of protrusions designed to 'snap' into the holes. Such hats are generally designed to accommodate head or hat sizes from 7 inches to 7.75 inches. The VELCRO closure system operates similarly, but utilizes a plurality of hook and loop fasteners on the opposing straps instead of snaps.

Hats constructed with closure systems such as these have similar problems. First, the wearer must adjust the hat to fit his head. Secondly, an incorrect adjustment is uncomfortable and can change the shape and look of the hat. Third, and particularly in the case of hats having a VELCRO fastening system, the closure mechanisms may become undone inadvertently. This may cause the hat to fall off the user's head. The user will then be forced to re-adjust their hat. Further, such closure systems are subject to wear and tear. The fastening means and straps will start to wear down with use. This leads to a decreased ability to securely keep the hat in the correct size for the user's head.

Another type of hat that may fit a multiple of head sizes is shown in U.S. Pat. No. 5,715,540 (the "'540 patent"), to Cho. The '540 patent teaches a "Free-size cap" designed to be capable of fitting wearers having a range of head sizes. The main body of the hat has a multiple of panels forming a crown portion. At least some of these panels (gores) are capable of being stretched in the peripheral direction. The sweatband may also be uniaxially stretched. As such, this hat may be worn by wearers having a head size within a pre-determined range.

One disadvantage to the invention of the '540 patent is that the elastic or stretch material may become over-stretched. The stretchable nature of the material decays over time with normal use. This may particularly occur when the material is stretched taut over a loop for the purpose of embroidering a design or logo on it. As such, the hat of the '540 patent is not well suited to being embroidered. Another disadvantage to the invention of the '540 patent is that the peripherally elastic panels may cause marks on the forehead or hair as well as discomfort to wearers at the larger end of the acceptable range of head sizes. Additionally, for wearers who fall at the smaller end of the acceptable range of head size, there are wrinkles in the stretchable panels.

Another example of a known multi-size hat is shown in U.S. Pat. No. 5,926,850 (the "'850 patent), to Han. The '850 patent teaches a "Fit Cap" that is designed to be capable of fitting wearers having a range of head sizes. The hat incorporates a sweatband composed of uni-directionally stretchable fabric aligned to stretch only along an axis that is perpendicular to the bottom and top edges of the sweatband. One disadvantage to the invention of the '850 patent is that the sweatband is made of one piece of material. It is not designed to absorb the perspiration that often accompanies the wearing of the hat. A further disadvantage to the invention of the '850 patent is that the material of the sweatband is not designed to be smooth; hence it can leave marks on the forehead or hair. Additionally, the sweatband of the '850 patent is only flexible in a uni-axial direction that is perpendicular to the top and bottom edges of the sweatband. This would not expand circumferentially to allow for a larger head size.

Due to the manner in which hat are distributed and sold, it is desirable to have comfortable, durable hats that will fit wearers having a range of head sizes. Wearers are always seeking to find comfortable, fashionable headwear. It is more economical for retailers to stock such free-size hats, as they do not have to carry a large inventory in order to satisfy the market. This smaller stock reduces storage requirements. Additionally, the manufacture of the products will be more economical due to the reduced number of hat sizes that the manufacturer has to gear up for. These savings can result in a lower-priced product overall.

Additionally, it is simpler to have hats that fit wearers having a range of head sizes. The design of the present invention will allow friends and families to buy a durable hat for another that has the appearance of being fitted to his head and that is comfortable to wear. They do not have to sacrifice the superior appearance of a fitted hat for the convenience of an adjustable one. Additionally, wearers will not have to have their heads measured to the nearest ⅛ of an inch. Instead, they can wear a medium or large hat with the comfort and fit of a hat that is made to fit their head.

Thus, a means for overcoming the deficiencies of the prior art is desired.

SUMMARY OF THE INVENTION

The versatile item of the present invention eliminates the disadvantages of the multi-size and custom pre-sized style hats.

An advantage of the versatile item of the present invention is that it provides the aesthetic look of an item which is designed to be fitted to the head, yet it is capable of fitting users having head sizes which fall within a predetermined range. The versatile item of the present invention is preferably available in two sizes: medium and large.

An advantage of the present invention is that the multi-axial stretch of the fabric of the invention and the sweatband allows for stretching around the head both circumferentially and vertically.

An advantage of the versatile item of the present invention is that it is comfortable and easy to wear.

The versatile item of the present invention has an additional benefit of an improved flexible band (which will be referred to as the sweatband) which may be stretched multi-axially. The sweatband is made of soft and smooth flexible materials such as polyester, spandex and cotton. This is in contrast to the current state of the art which teaches the use of grid-like elastic bands with a uni-axial stretch. The smooth texture and feel of the multi-axially flexible sweatband provide a snug, comfortable and non-oppressive fit. Additionally, the polyester and polyester/SPANDEX® blend materials of the sweatband of the present invention are more absorbent than the uni-axial elastics of the current state of the art which incorporate rubber. The sweatband also allows for an improved amount of circulation and breathability. Further, since the sweatband is smooth, it is much less likely to leave marks on the forehead or hair of the wearer than hats with a traditional, elastic band.

An advantage of the present invention is that it is capable of absorbing the perspiration that normally accompanies the wearing of an item on the head, thus allowing for a dryer, more comfortable wear.

Another significant advantage of the present invention is that the gores of the cap structure use existing and unaltered materials which do not have elastics incorporated therein. Instead, the flexibility of the cap structure comes from manner in which the gores are aligned. The multi-gore shell of the cap structure of the present invention is comprised of bias cut fabric aligned at varying angles to achieve the maximum natural multi-axial stretch of said fabric.

The method of modified fabric alignment which maximizes the natural stretch of the material is versatile and not limited to any specific fabric type. The method can incorporate a multitude of materials in the free size cap line including, but not limited to, cotton twill, polar fleece, polyester mesh and wool and acrylic blends. The present invention does not require specially formulated or woven fabrics that incorporate elastic or other similar materials. As such, the manufacturer may use many of the fabrics that are readily available on the market. The ability to buy readily available materials from a variety of producers reduces the cost of manufacture.

The end product of the present invention is aesthetically desirable as the unaltered composition of the material holds its shape better than synthetic elastic materials. Additionally, since the end product is manufactured from unaltered materials, the product is more durable and sturdy.

The unaltered nature of the material of the present invention provides additional benefits. For example, fabric breathability is allowed with 100% natural cotton twill. Additionally, since the present invention does not contain elastic or similar products in its crown or outer portion, all areas may be embroidered cleanly without losing their original shape. For example there is a marked reduction in the fabric wrinkling and over-stretching that occurs when other flexible caps made from SPANDEX® blends undergo the embroidery process.

Another significant advantage of the present invention is that the multi-axial stretch structure allows for a more comfortable fit and smoother feel as the user places the hat on their head. The generally vertical stretch coupled with the roughly circumferential stretch allows the hat to more fully conform to the shape of the user's head.

Additionally, the use of existing materials which do not have to be altered reduces manufacturing costs. Manufacturers do not have to formulate or produce new materials. Instead, they can save time and money by purchasing finished materials from sources competing among themselves for the business.

Further, the unique method used to manufacture the present invention is not limited to the shape of the traditional baseball hat style. A variety of headwear styles can be constructed without further modification of the present technique. The visor style, for example, can adopt the present method and offer the industry a revolutionary way of marketing headwear outside of the dominant baseball hat style. The free size visor uses the same comfortable and absorbent sweatband as well as the same fabric and fabric alignment that is unique to the crown of the free-size fitted style cap.

DETAILED DESCRIPTION OF THE PREFERRED EMBODIMENT

Figure 1A:
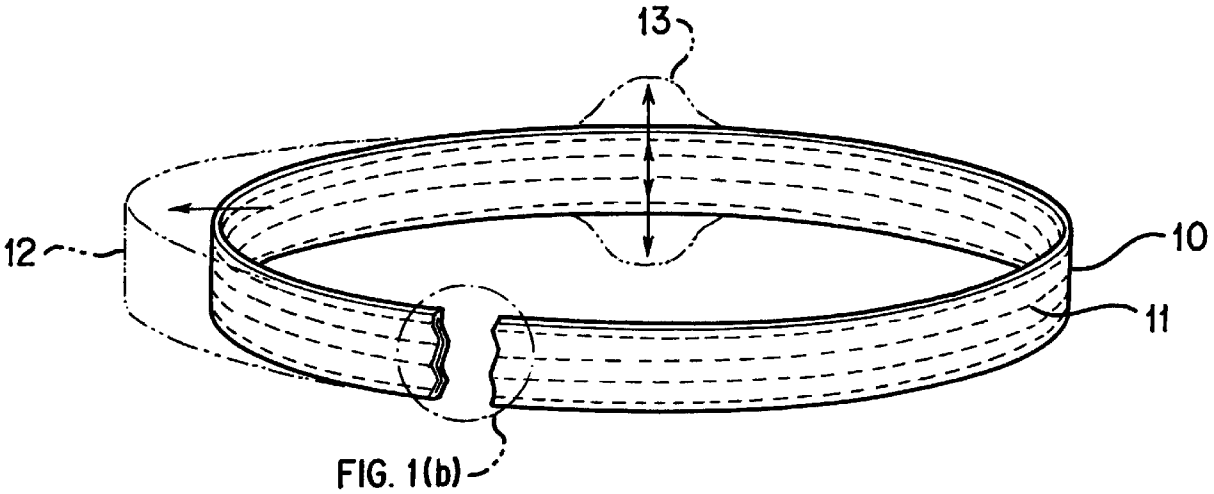
FIGS. 1(*a*) and (*b*) depict the sweatband 10 of the present invention.
Figure 1B:
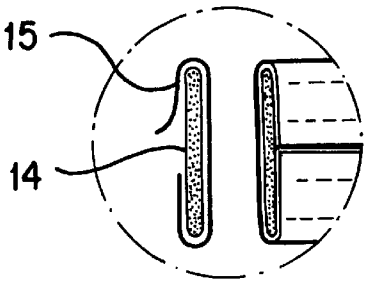

FIG. 1(*a*) is a depiction of the sweatband 10 of the present invention. Four rows of flexible stitching 11 are also shown. The flexible stitching 11 may be made of spandex or similar material. Arrows 12 and 13 indicate that the sweatband may be stretched circumferentially and width-wise (vertically), respectively.

FIG. 1(*b*) shows that the sweatband is composed of an interior core 14 and an exterior shell or layer 15. The interior core 14 may be made of polyester. The exterior shell or layer 15 may be made of a mix of cotton and spandex.

Figure 2:
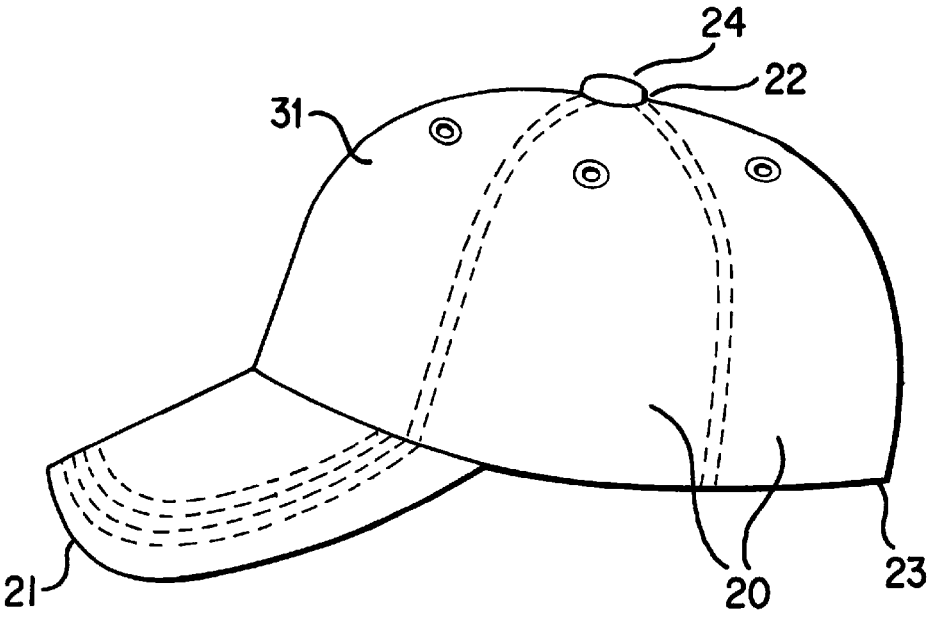
FIG. 2 shows a completed embodiment of the present invention in the form of a baseball cap.
Figure 3:
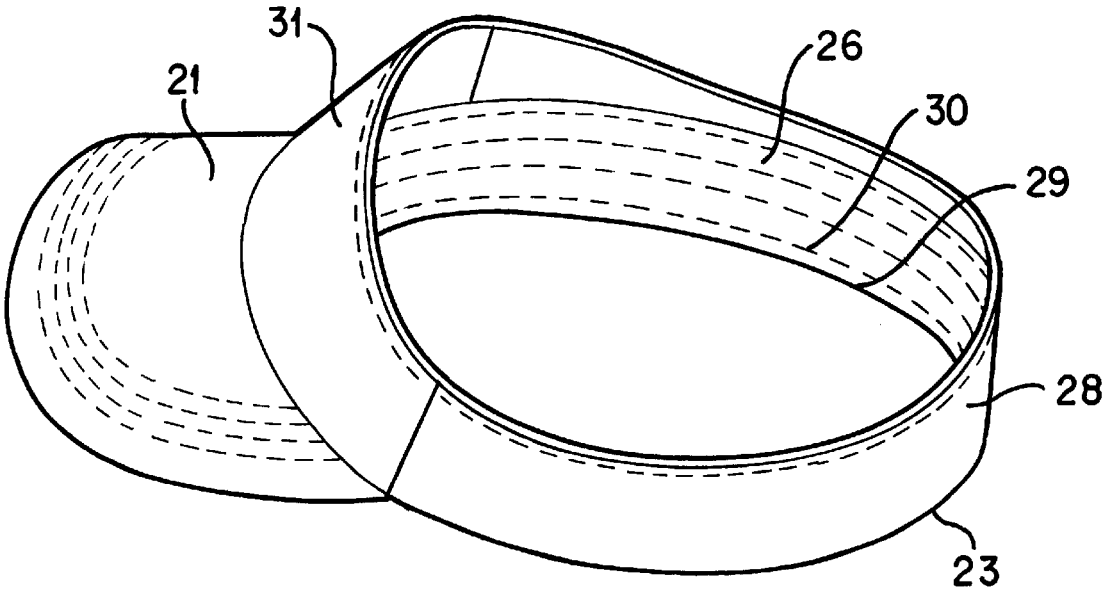
FIG. 3 shows a completed embodiment of the present invention in the form of a visor.

FIGS. 2 and 3 show how the sweatband and material of the present invention may be incorporated into an item to be worn on the head.

FIG. 2 shows a view of the left side of a cap which is one embodiment of the present invention made with the bias cut fabric aligned at appropriate angles to achieve the maximum natural multi-axial stretch of said fabric. The angle of the fabric is not shown, but it should be understood by one skilled in the art that the gores 20 should be cut so that the angles of the material which provide the maxim stretch are aligned in a way so that the circumferential and vertical stretch is maximized. The flexible stitching 11 combines with the multi-axial stretch of the fabric adjust to provide a unique flexibility that comfortably forms a crown portion that is capable of fitting many different head sizes. In another embodiment of the present invention, the flexible stitching 11 combines with the multi-axial stretch of the fabric to form a head band portion similar to outer portion 28 that is capable of fitting many different head sizes. The apex 22 where the narrow ends of the gores 20 meet is shown in FIG. 2 with a button 24 sewn on for aesthetic appeal.

The curved visor portion 21 of the present invention and the lower peripheral edge 23 of the gores 20 are also shown in FIG. 2.

FIG. 3 shows a view of a visor-like hat that is one embodiment of the present invention. The visor-like hat has a visor 21 and an outer portion 28 that encircles the head. The flexible stitching 30 of the sweatband 26 is arranged circumferentially. In this figure it is possible to see how the sweatband 26 of the present invention is incorporated into headwear. The lower edge 29 of the sweatband 26 is attached to the inside of the lower peripheral edge 23 of the outer portion 28 of the invention.

The frontal panels 31 of the embodiments of the present invention as shown in FIGS. 2 and 3 may be constructed of more rigid material than either the flexible gores 20 or the outer portion 28 that encircles the head. This allows the headwear to support the visor 21 so it extends from the headwear.

The visor portion that accompanies one embodiment of the present invention is non-stretchable and relatively rigid.

The presently disclosed embodiments are therefore to be considered in all respects as illustrative and not restrictive, the scope of the invention being indicated by the appended claims, rather than the foregoing description, and all changes that come within the meaning and range of equivalency of the claims are therefore intended to be embraced therein.

What is claimed is:

1. A hat-like structure that gives the appearance of being fitted and is able to be worn by wearers having a variety of different head sizes comprising:

a crown portion having an interior surface and an exterior surface which is comprised of gores having both a broad and a narrow end, wherein a multiple of said gores are aligned so as to maximize the natural stretch of the fabric, and wherein the crown portion has an apex where the narrow ends of said gores meet and a lower peripheral edge outlined by the broad ends of the gores;

a visor portion secured to the front of said structure and extending outwardly therefrom;

a sweat band having a bottom edge and a top edge, wherein the sweat band is comprised of an inner polyester core generally surrounded by an outer layer which is composed of a blend of cotton and spandex; and a plurality of rows of flexible yarn stitching on the sweat band generally in the direction of the circumference of the crown portion, wherein said sweat band is circumferentially attached to said interior surface of the lower peripheral edge of the crown portion.

2. The hat-like structure as in claim 1, wherein said gores are fabricated from a multiaxially stretchable material.

3. The hat-like structure as in claim 1, wherein said crown has a frontal portion that is rigid.

4. The hat-like structure as in claim 1, wherein the visor is bent in an arc of from about 5 degrees to about 65 degrees from horizontal on each side.

5. The hat-like structure as in claim 1, wherein the arc of the visor is capable of being modified by the user in the range of from about horizontal to about 85 degrees from horizontal on each side, wherein the hat will retain the desired curved shape.

6. The hat-like structure as in claim 1, wherein the sweatband's outer layer is comprised of from about 0 to about 4 percent by weight spandex and from about 96 to about 100% by weight cotton.

7. The hat-like structure as in claim 1, wherein the sweatband's inner core is comprised of polyester.

8. The hat-like structure as in claim 1, wherein the flexible yarn stitching is made of spandex.

9. The hat-like structure as in claim 1, further including a plurality of openings disposed on the crown portion extending from said exterior surface to said interior surface.

10. An article of manufacture which is designed to be worn on and around the head, wherein the article has a portion that encircles the head which appears to be tailored to a specific head circumference but instead is suitable for a variety of different head sizes, the article including:

an outer portion having an interior surface and an exterior surface, wherein said outer portion is constructed in part from fabric aligned at an angle maximizing the natural stretch of the fabric;

a sweat band having a bottom edge and a top edge, wherein the sweat band is comprised of an inner polyester core generally surrounded by an outer layer which is composed of a blend of cotton and spandex; and a plurality of rows of flexible yarn stitching on the sweat band generally in the direction of the portion of the article which encircles the head;

wherein the sweat band is circumferentially attached to said interior surface of the article of manufacture.

11. The article as in claim 9, wherein the outer portion is composed of multi-axially flexible material.

12. The article as in claim 9, wherein the sweatband's outer layer is comprised of from about 0 to about 4 percent by weight spandex and from about 96 to about 100% by weight cotton.

13. The article as in claim 9, wherein the flexible yarn is spandex.

* * * * *